US006135720A

United States Patent [19]

Boller

[11] Patent Number: 6,135,720

[45] Date of Patent: Oct. 24, 2000

[54] AIR COMPRESSORS OF SLIDING VANE ECCENTRIC ROTOR TYPE

[75] Inventor: Edward Boller, Halesowen, United Kingdom

[73] Assignee: CompAir Hydrovane Limited, Worcestershire, United Kingdom

[21] Appl. No.: 09/124,412

[22] Filed: Jul. 29, 1998

[30] Foreign Application Priority Data

Jul. 29, 1997 [GB] United Kingdom ..... 9716003

[51] Int. Cl.[7] ..... F04B 49/06

[52] U.S. Cl. ..... 417/45; 417/44.2; 417/26; 318/773; 318/771

[58] Field of Search ..... 417/45, 44.2, 26; 318/773

[56] References Cited

U.S. PATENT DOCUMENTS

| | | | |
|---|---|---|---|
| 4,370,605 | 1/1983 | Breznican | 318/773 |
| 4,406,589 | 9/1983 | Tsuchida et al. | 417/300 X |
| 4,477,760 | 10/1984 | Kuznetsov | 318/773 |
| 4,489,265 | 12/1984 | Kuznetsov | 318/773 |
| 4,644,242 | 2/1987 | Takata et al. | 318/773 X |
| 4,756,669 | 7/1988 | Hata | 417/45 X |
| 4,819,123 | 4/1989 | Hatimaki | 417/26 |
| 4,863,355 | 9/1989 | Odagiri et al. | 417/44 X |

FOREIGN PATENT DOCUMENTS 1318884 of 1970 United Kingdom .

1599319 of 1978 United Kingdom .

*Primary Examiner*—William Doerrler
*Assistant Examiner*—Chen-Wen Jiang
*Attorney, Agent, or Firm*—Reed Smith Shaw McClay LLP

[57] ABSTRACT

An air compressor includes a stator, which includes an inlet and an outlet and defines a substantially cylindrical bore, and a rotor eccentrically rotatably mounted in the bore. The rotor is connected to be rotated by a three-phase asynchronous electric motor of pole amplitude modulated type which is switchable between low speed six pole operation and high speed four pole operation under the control of a controller. A pressure sensor communicates with the compressor outlet and is connected to the controller which is arranged to produce a first signal when the compressor discharge pressure falls below a first threshold value and a second signal when this pressure rises above a second threshold value. Each of the three electrical power supply lines of the motor is associated with a respective impedance, which is connected in parallel with a shunt path including a respective switching device, which is switchable under the control of the controller, whereby when the switching device is closed the impedance is shunted and is effectively switched out of the associated power line and when the switching device is open the shunt path is interrupted and the impedance is effectively switched into the power supply line. The controller is arranged so that when the compressor is operating at low speed and the first signal is produced the motor is switched to operate at high speed and when the compressor is operating and high speed and the second signal is produced the compressor is switched to operate at low speed.

9 Claims, 3 Drawing Sheets

AIR COMPRESSORS OF SLIDING VANE ECCENTRIC ROTOR TYPE

BACKGROUND OF THE INVENTION

The present invention relates to electric motor driven air compressors of sliding vane eccentric rotor type and is concerned with minimising the power consumption of such compressors when the compressor is subjected to a varying demand for compressed air.

Compressors of this type are well known and are disclosed in numerous prior documents such as British Patent No. 1318884. Such compressors are normally driven by four pole asynchronous electric motors at a speed of a little less than 1500 rpm with a 50 Hz power supply and 1800 rpm with a 60 Hz power supply. It is desirable for reasons for minimum use of energy to ensure that the output of the compressor matches the demand for compressed air as closely as possible and numerous ways of doing this are known. The simplest and best known way of doing this is to provide the compressor with a simple unloader valve and such a valve is disclosed in British Patent No. 1318884. An unloader valve comprises a valve cooperating with the compressor inlet and operated by a servo device which is subjected to the compressor delivery pressure. As the delivery pressure rises above the normal value, thereby indicating that the demand for compressed air is less than the rate at which it is being supplied, the servo device causes the unloader valve to move progressively to throttle the compressor inlet and thus to reduce the supply of compressed air. However, as the inlet is throttled, the pressure at the inlet of the compressor falls to a sub-atmospheric value and this means that the pressure differential across the vanes of the compressor increases and the discharge pressure of the compressor increases. This results in more energy being required to rotate the rotor and it is found in practice that in a conventional compressor provided with an unloader valve the energy consumption when the demand for compressed air is zero is approximately 70% of the energy consumption when the compressor is producing its nominal rated output.

A more sophisticated system for minimising power consumption is disclosed in British Patent No. 1599319 in which the compressor is provided not only with an unloader valve of the type referred to above but also with a minimum pressure valve which is arranged selectively to close the outlet and a vent valve arranged to vent the interior of the compressor, all of which are connected to a controller. The controller includes a timer and when the unloader valve has been closed for a predetermined period of time, thereby indicating that the demand for compressed air has been zero for that period of time, the minimum pressure valve is closed whilst maintaining the unloader valve closed and the vent valve is opened. The interior of the compressor is then vented down to a predetermined low pressure which results in a significant decrease in the power consumed when there is no demand for compressed air. However, it is not possible to reduce the pressure in the compressor to zero, since a certain minimum pressure is necessary in order to inject oil from the compressor sump into the interior of the stator. Furthermore, if the demand for compressor air is in fact not zero but is at a relatively low level the compressor will cycle repeatedly between the full load condition and the vented down condition and the repeated venting down of the interior of the compressor followed by the necessity of repressurising the interior of the compressor results in the compressor in accordance with British Patent No. 1599319 still consuming a substantial proportion of the full load power consumption even when the demand for compressed air is at only a small fraction of the full rated load.

Economy of operation is becoming increasingly important and it is therefore the object of the invention to provide an air compressor of sliding vane eccentric rotor type in which the energy consumption is substantially reduced, when the compressor is subjected to a varying demand for compressed air, by comparison with that disclosed in British Patent No. 1599319.

One superficially attractive way of varying the output of the compressor to match changes in demand and simultaneously reduce the power consumed would be to change the speed of the motor and this is particularly attractive for a quite separate reason, namely that in contrast to compressors of screw type, whose efficiency may drop when their speed drops, the efficiency of a compressor of sliding vane eccentric rotor type rises somewhat as the speed drops. This increase in efficiency with reduced speed is however only achieved down to a critical minimum speed of something less than 1000 rpm because below this value instability or chatter of the blades sets in. Thus at speeds significantly below 1000 rpm the centrifugal force acting on the blades and tending to force them into contact with the internal surface of the bore in the stator is insufficient to withstand the pressure differential across the blades which therefore repeatedly lift away briefly from the surface of the stator bore and permit leakage of compressed air between the two compression cells which they separate. It is also found empirically that it is not efficient to operate compressors of sliding vane eccentric rotor type at speeds much greater than 1500 rpm because if they are operated at such a speed the increase in the contact pressure between the vanes and the surface of the stator bore caused by the increase in the centrifugal force acting on the vanes results in increasing frictional losses and thus in decreasing mechanical efficiency. There is, therefore, in practice a relatively narrow speed range in which such compressors must be operated, that is to say between something above 1500 rpm and something below 1000 rpm.

Whilst it would in theory be possible to use a variable speed motor and to vary the speed of the motor within the range set forth above in order to match the output of the compressor to the demand for compressed air, it is found that the capital cost of such motors and their attendant control systems is unacceptably high. A further possibility would be to provide variable gearing between the compressor and a constant speed motor but such gearing is also unacceptably expensive. For these various reasons, no significant progress has therefore been made with variable speed compressors of sliding vane eccentric rotor type.

However, pole amplitude modulated (PAM) motors have recently become available. Such motors are manufactured and sold by Brook Hansen and others. Such motors may be switched from four pole to six pole operation, thereby changing their speed from a little under 1500 rpm to a little under 1000 rpm, by altering the position of the electrical supply connections. The use of such PAM motors in connection with sliding vane compressors in order to produce a variable speed compressor is therefore superficially very attractive but they are in practice not as attractive as would be expected, due in part to the substantial noise which is generated when the motor is switched between high and low speeds and, more importantly, due to the fact that there is a substantial, though brief, current surge when switching below high and low speeds. This current surge leads to a brief substantial drop in voltage of the power supply and this is not only disconcerting in that it tends to result in flickering of the lighting but is also highly disruptive in that it can lead to malfunctioning of sensitive electronic equipment, such as computers, and is also potentially dangerous in that, for instance, machine tools incorporating magnetic chucks may lose control of their work piece. These problems currently render the use of PAM motors in conjunction with compressors unacceptable and the only way in which these problems could be overcome would be by installing a much higher rated power supply and this would be wholly unacceptable due to the very substantial cost involved.

SUMMARY OF THE INVENTION

According to the present invention, there is provided an air compressor of sliding vane eccentric rotor type including a stator, which includes an inlet and an outlet and defines a cylindrical bore, and a rotor eccentrically rotatably mounted in the bore, the rotor being connected to be rotated by a three-phase asynchronous electric motor of pole amplitude modulated type which is switchable between low speed six pole operation and high speed four pole operation under the control of a controller, a pressure sensor communicating with the outlet and connected to the controller which is arranged to produce a first signal when the compressor discharge pressure falls below a first threshold value and a second signal when the compressor discharge pressure rises above a second threshold value, each of the three electrical power supply lines of the motor being associated with a respective impedance, which is connected in parallel with a shunt path including a respective switching means, which is switchable under the control of the controller, whereby when the switching means is closed the impedance is shunted and is effectively switched out of the associated power supply line and when the switching means is open the shunt path is interrupted and the impedance is effectively switched into the power supply line, the controller being so arranged that when the compressor is operating at low speed and the first signal is produced the motor is switched to operate at high speed and when the compressor is operating at high speed and the second signal is produced the compressor is switched to operate at low speed, the controller also being so arranged that when the compressor is switched on or switched between high and low speeds the impedances are switched into the associated power lines for a predetermined period of time and are switched out of the associated power lines at all other times.

Thus the compressor in accordance with the invention is operated by a PAM motor and the problems referred to above are overcome by the provision of an impedance in the power supply lines of the motor. The value of the impedances will depend on requirements and the power of the motor but is typically between 0.05 and 0.5 ohms. Each impedance is provided with a switchable bypass line such that when the switches are open the impedances are connected in series with the supply lines. However, when the switches are closed, the impedances are short-circuited and are effectively switched out of the supply lines. The impedances are switched into the supply lines only when switching the compressor on and when switching the compressor between high and low speeds and the period for which they are switched in is a very brief one. The duration of this period will again depend on requirements and the rated power of the motor but is typically between only 0.1 and 0.5 seconds. The presence of the impedances in the supply circuit at the time the power surge occurs results in the power surge being substantially damped and thus in the problems referred to above being substantially reduced, that is to say reduced to an acceptable magnitude. Although the presence of the impedances in the supply circuit results in a slight increase in the power consumption, this increased power consumption occurs for such a brief period of time that it has a negligible effect on the overall power consumption and thus efficiency of the motor.

Thus if the motor is operating at high speed and the demand for compressed air is less than the rate of supply, the compressor is switched to low speed thereby bringing supply more closely into line with demand. Similarly, if the compressor is operating at low speed and the demand for compressed air exceeds the rate of supply, the compressor is switched to high speed.

The pressure sensor may be a transducer which continuously produces an electrical output representative of the discharge pressure of the compressor and in this event the magnitude of the electrical output will be sensed by the controller which will detect when the output reaches first and second threshold values, corresponding to the first and second signals, respectively, thereby indicating that the discharge pressure has fallen to the first threshold value or risen to the second threshold value, respectively. Alternatively, the pressure sensor may constitute two pressure switches which are arranged to open or close when the discharge pressure falls below the first threshold value or rises above the second threshold value, the opening or closing of the pressure switches resulting in the generation of the first and second signals.

It is preferred that the features referred to above are provided in conjunction with the further power saving features disclosed in British Patent No. 1599319. It is therefore preferred that the compressor inlet cooperates with an unloader valve which includes a servo device, subject to the compressor delivery pressure, and is adapted to progressively throttle the inlet as the delivery pressure rises above a predetermined value and is connected to the controller, the controller being arranged to enable and disable the unloader valve. However, as explained above, whilst an unloader valve is effective in matching the supply of compressed air to demand, there is an efficiency penalty coupled with it and it is therefore preferred that the controller is arranged normally to disable the unloader valve, and thus ensure that it remains open, when the motor is operating at high speed.

The time taken for the motor to accelerate from low speed to high speed is typically around 1 second or rather less but this time can be reduced if the compressor and thus the motor are required to perform a reduced amount of work whilst the acceleration process is taking place. It is therefore preferred that the controller is arranged to close the unloader valve for a predetermined period of time when the motor is switched from low speed to high speed.

If the demand for compressed air is only slightly above the rate at which it is supplied when the motor is operating at low speed, there would be a tendency for the motor to cycle rapidly between high and low speeds. This is somewhat inefficient and can furthermore result in overheating of the motor. Accordingly, if this condition is present it is desirable that the switching of the motor between high and low speeds be temporarily suppressed and that the matching of supply to demand be effected by the unloader valve, notwithstanding the inefficiency associated with the use of this valve. Accordingly, in one embodiment of the invention, the controller includes a counter arranged to count the number of switching operations, in which the motor is switched on or switched between high and low speeds, in a predetermined preceding period of time and is arranged to enable the unloader valve, when the motor is operating at high speed, when the number of switching operations in the predetermined period of time exceeds a predetermined number. Alternatively or additionally, the motor includes a temperature sensor connected to the controller and the controller is arranged to enable the unloader valve and thus cause it to operate normally, when the motor is operating at high speed, when the temperature of the motor sensed by the temperature sensor exceeds a predetermined value.

If the demand for compressed air should drop to a low value or zero, it may remain there for some period of time and it is undesirable for the compressor to be rotated with the normal working pressure differentials across the vanes for any extended period of time for which there is substantially no demand for compressed air. It is therefore preferred that the compressor outlet includes a minimum pressure valve arranged selectively to close the outlet at a predetermined pressure and a vent valve communicating with the outlet at a position upstream of the minimum pressure valve and arranged selectively to open under the control of the controller to vent the interior of the compressor, the controller being arranged to enable the unloader valve when the motor is operating at low speed and to sense if the unloader valve is closed and the compressor discharge pressure is above the second threshold value and then to open the vent valve whilst holding the unloader valve closed, thereby venting the interior of the compressor down to a predetermined pressure. In this embodiment, if the demand for compressed air should be substantially zero for a predetermined time of, say, 2 minutes or more, the interior of the compressor is effectively sealed by means of the unloader valve and the minimum pressure valve and is vented down to a relatively low pressure of, say, 2 bar which leads to a reduction in the power consumption of the motor. If the demand for compressed air should return, normal operation is resumed. However, if the demand for compressed air should remain at substantially zero for an extended period of time, a timer integrated in the controller may be arranged to switch the motor off completely after a further predetermined period of time has elapsed.

When the motor is switching from high speed to low speed, there is no need for any electrical power to be supplied to the motor at all because this would result in an unnecessary consumption of electrical power. It is therefore preferred that the controller is arranged to apply no electrical power to the motor for a predetermined period of time when the motor is switched from high speed to low speed. The predetermined period of time may be in the region of 0.25 seconds and is preferably set to be substantially that period of time which is necessary for the speed of the motor to decelerate naturally from high speed to low speed. Once low speed has been reached and/or the predetermined period of time has elapsed, electrical power is applied to the motor by way of the low speed connections and for the initial period of time during which there would be a substantial current surge the impedances are again connected into the supply circuit.

BRIEF DESCRIPTION OF THE DRAWINGS

Further features and details of the present invention will be apparent from the following description of one specific embodiment of compressor of sliding vane eccentric rotor type in conjunction with a motor and associated control system which is given by way of example with reference to the accompanying drawings, in which.

DETAILED DESCRIPTION OF THE INVENTION

Figure 1:
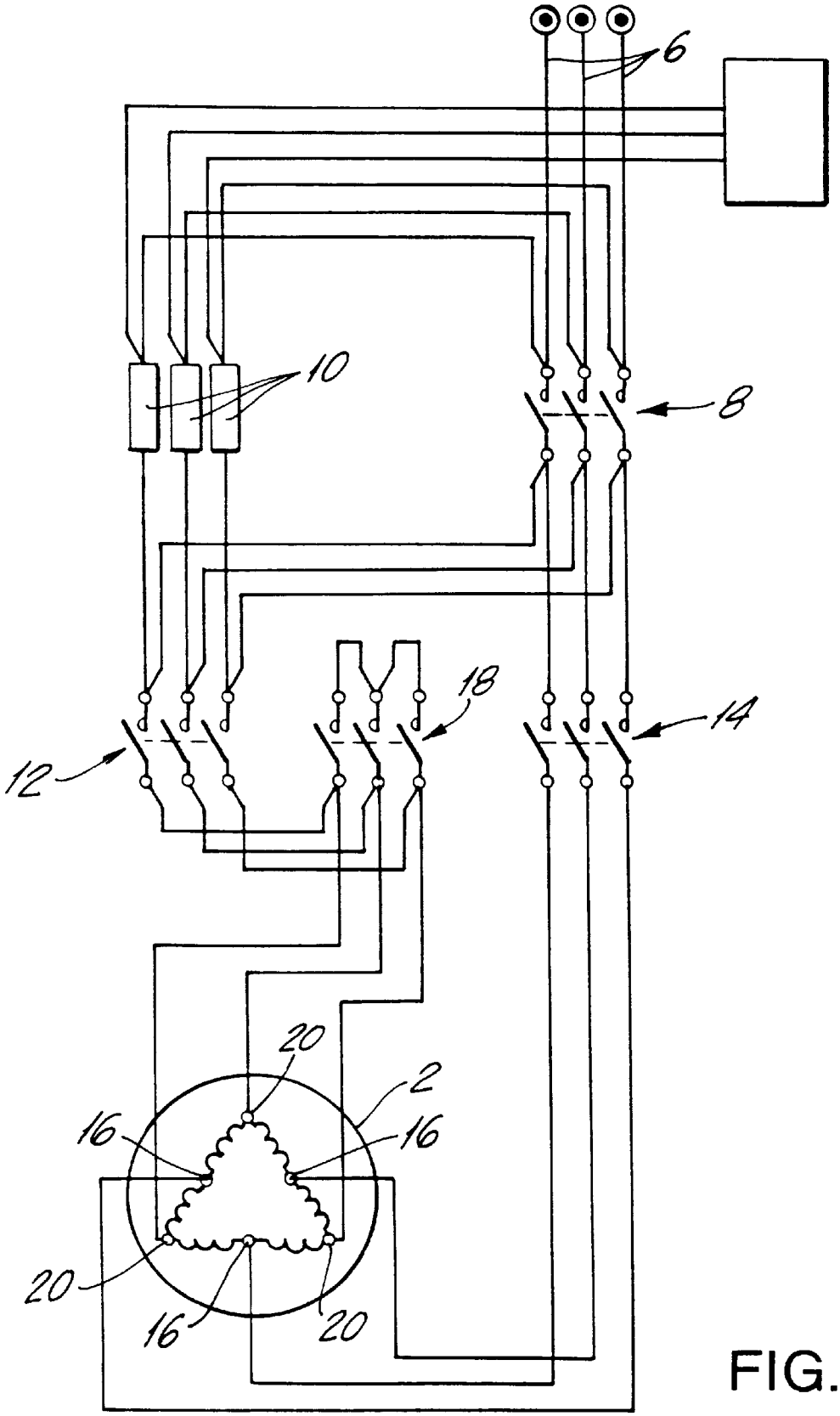
FIG. 1 which is a circuit diagram of a PAM motor connected to a compressor (not shown) and the associated power supply lines and contactors and also shows the controller wholly schematically.
Figure 2:
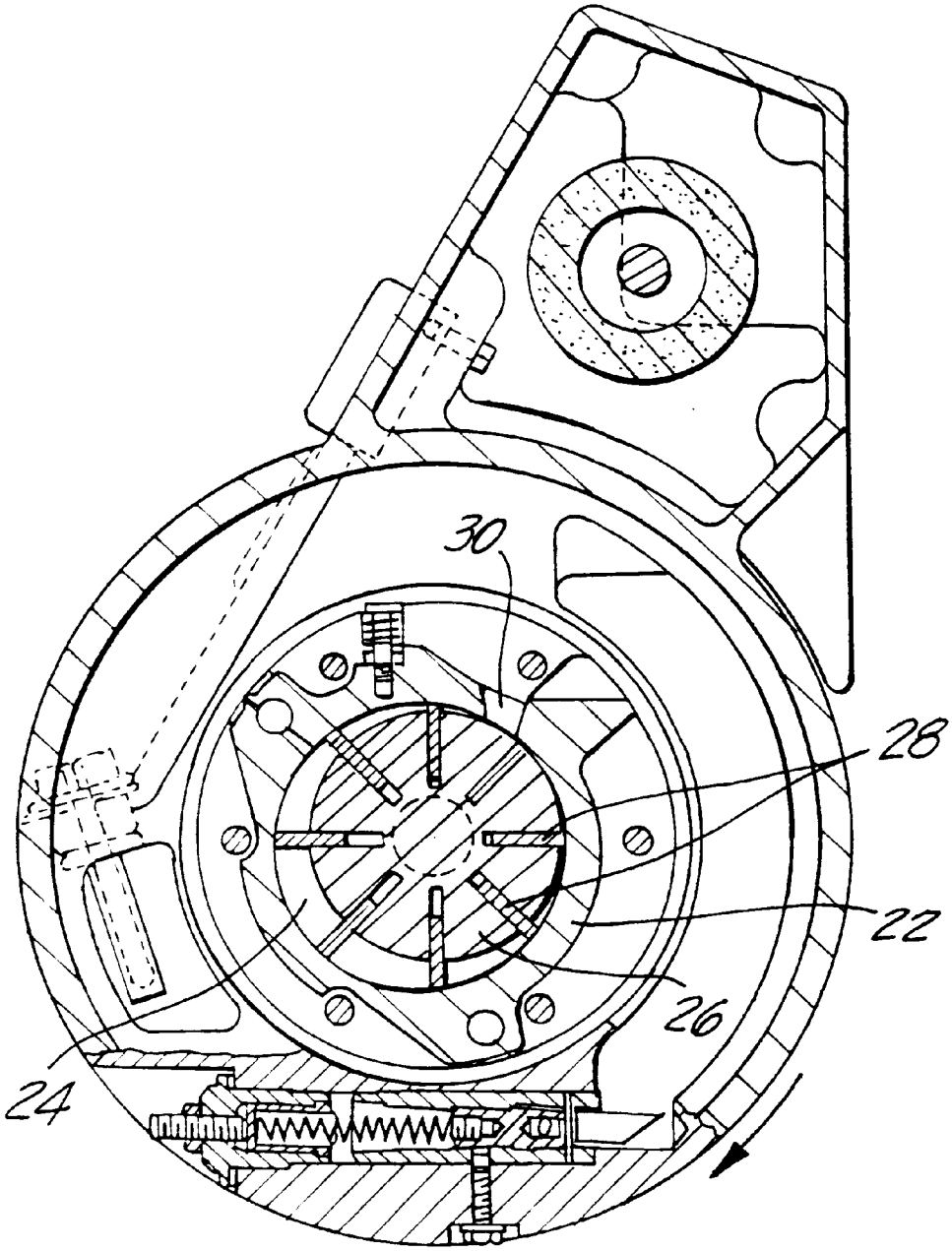
FIGS. 2 and 3 are schematic illustrations showing various components of a motor which may be applied to the present invention.
Figure 3:
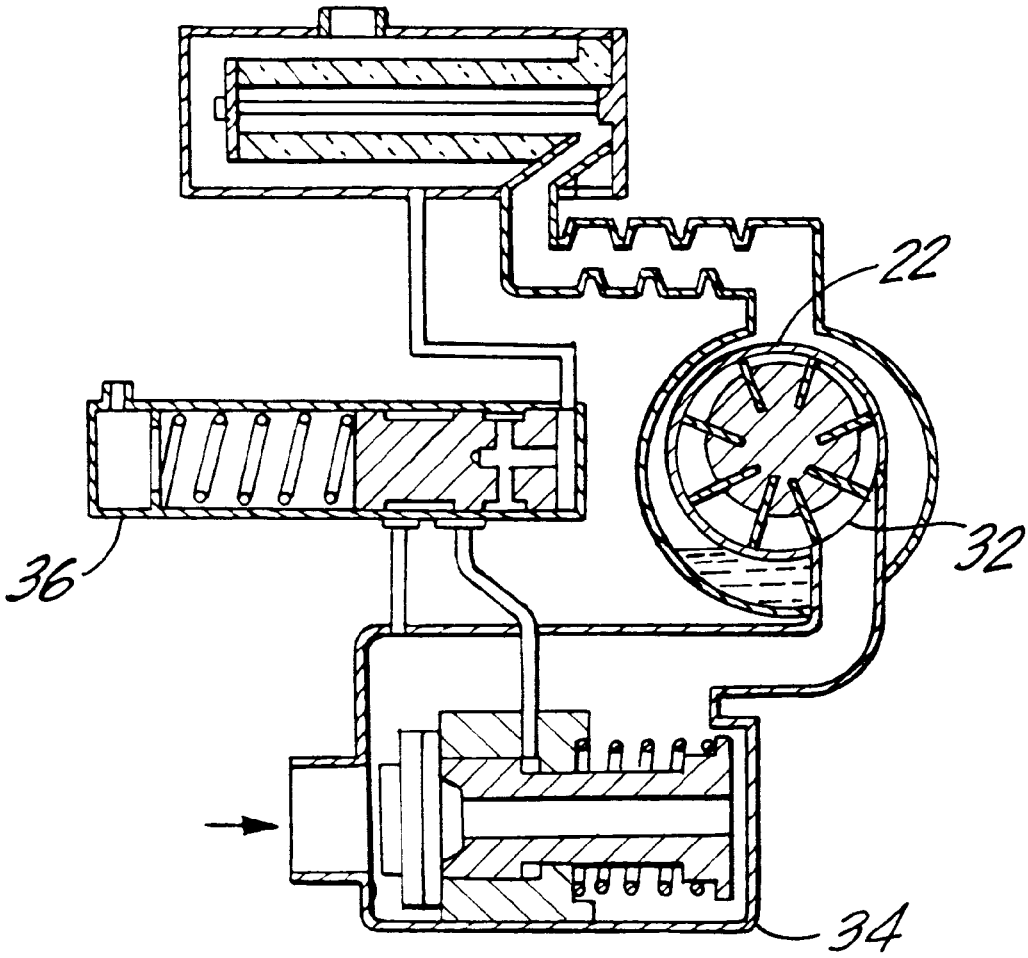

The compressor itself is of essentially known construction and will therefore be described only briefly. With reference to FIGS. 1–3 of the drawings, the compressor comprises an outer casing in which there is a stator defining a cylindrical bore, 24 eccentrically rotatably accommodated within which is a cylindrical rotor. The rotor 26 is connected to an axial drive shaft and formed in its peripheral surface is a number, typically eight, of longitudinally extending radial slots. Slidably accommodated in each slot is a vane 28. The rotor and stator together define a crescent shaped compression space which is divided into a number of compression cells by the vanes. In use, as the rotor rotates, the volume of each compression cell progressively increases and then decreases, thereby compressing the air within it. An air inlet 32 extends through the stator and communicates with the cells over that time for which their volume is increasing. An air outlet 30 also passes through the stator and communicates with the cells at that time at which their volume reaches a minimum.

The lower portion of the outer casing defines an oil sump which, in use, is subjected to the compressor delivery pressure. This pressure forces oil in the sump through injectors situated in the stator wall which inject oil into the compression cells. This oil lubricates the vanes and ensures that there is a satisfactory seal between the outer tips of the vanes and the internal surface of the stator, against which the vanes are pressed by centrifugal force, and also is responsible for removal of much of the heat produced by the substantially adiabatic compression of the air.

The compressed air flows out through the outlet with a fine mist of oil droplets entrained in it which are subsequently removed from the air with the aid of one or more separators and returned to the sump for reuse. The compressed air, substantially free of oil, is then used for whatever purpose it is required.

The rotor drive shaft is connected to an electric motor 2 in the conventional manner but the motor is a three phase asynchronous motor of PAM type which is switchable between 6 pole and 4 pole operation and is thus switchable between operating speeds of a little under 1000 rpm and a little under 1500 rpm, when the electric mains frequency is the European standard of 50 Hz. The switching between the two operating speeds is effected under the control of a microprocessor-based controller 4. Arranged in the three power supply lines 6 to the motor 2 is a bypass contactor 8 whose input side is connected to one side of a respective impedance 10 for each power supply line 6. Each impedance is, conveniently of 0.1 ohms in the case of a 75 KW motor. The output side of the bypass contactor 8 is connected to the other side of the impedances 10, the input side of a low speed contactor 12 and the input side of a first high speed contactor 14. The output side of the high speed contactor 14 is connected to the high speed connections 16 of the motor 2. The output side of the low speed contactor 12 is connected to a second high speed contactor 18 and to the low speed connections 20 of the motor.

The inlet 32 to the compressor includes an unloader valve 34 of known type, as disclosed in e.g. British Patent No. 1318884. This unloader valve 34 is arranged to selectively close the inlet 32 and thus prevent air from being admitted into the compression space. The unloader valve is caused to move by a servo device 36, which is operated by the compressor discharge pressure and is arranged to be selectively enabled or disabled by a control signal from the controller.

The servo device has a spool, to one end of which compressor discharge pressure of e.g. 8 bar is applied and the other end of which is connected to the compressor inlet which is at atmospheric pressure or below. A point intermediate the two ends is connected to the spring loaded unloader valve which is caused to close progressively as the discharge pressure rises. Valves controlled by the controller are provided upstream and downstream of the servo spool. If the upstream valve is closed by the controller inlet pressure is applied to the unloader valve which is thus disabled and caused to remain open. If the upstream valve is opened and the downstream valve closed, compressor discharge pressure is applied to the unloader valve which is thus caused to remain shut.

Communicating with the outlet to the compressor is a pressure transducer which produces a signal indicative of the discharge pressure of the air. An increase in the discharge pressure indicates that the demand for compressed air is lower than the rate at which compressed air is actually being produced. The pressure sensor is connected to supply its output signal to the controller. Situated in the compressor outlet is a minimum pressure valve which is arranged selectively to close the outlet under the control of the controller. Also communicating with the compressor outlet at a position upstream of the minimum pressure valve is a vent valve which is arranged to be opened under the control of the controller so as to vent down the interior of the stator to a predetermined reduced pressure.

In use, the compressor is arranged to operate as follows: If it is desired to start the compressor from standstill, electric power is applied to the power supply lines 6 and the bypass contactor 8 is opened and the contactors 14 and 18 are opened also and the contactor 12 is closed. The power flows through the impedances 10 and the contactor 12 to energise the motor in 6 pole mode, that is to say in low speed mode. The current rises rapidly to a peak value, which is significantly lower than would be the case if the impedances were not present. After the current peak has largely subsided the controller closes the bypass contactor 8 after a time determined by a first timer integrated into the controller of typically 0.25 seconds whereby the impedances are shunted and are effectively switched out of the supply lines. Shortly thereafter the compressor reaches its normal low operating speed of slightly less than 1000 rpm and the current taken by the motor reaches its steady state low speed value. The delivery pressure of the compressor is constantly monitored by the pressure transducer and if the pressure should fall below a first threshold value, thereby indicating that the demand for compressed air exceeds the rate at which it is being supplied the controller switches the motor to high speed operation. This is done by the controller firstly sending an enabling signal to the unloader valve which moves to close the inlet. Once this has been done, typically after 800 ms, the electrical power is removed from the low speed motor contacts by opening the contactor 12. After a period of time of typically 15 ms set by a second timer integrated into the controller, the purpose of which is to permit arcing, voltage transients and the like to subside, the controller closes the high speed electrical power contactor 14 to energise the motor in 4 pole mode, that is to say in high speed mode, and at the same time the controller opens the contactor 8 and closes the contactor 18 so that the power is obliged to flow through the impedances 10. There is again a brief current surge and after elapse of the time set by the first timer of 0.25 seconds the contactor 8 is closed, thereby shunting out the impedances 10. After a further delay of typically 550 ms the unloader valve is caused to open. Shortly thereafter the compressor reaches its normal high operating speed of slightly less than 1500 rpm.

In high speed operation the unloader valve is normally disabled by the controller. The discharge pressure is monitored by the pressure transducer and if the pressure should rise above a second threshold value preset in the controller, thereby indicating that the demand for compressed air is less than the rate at which it is being produced, this is compensated for not by throttling the compressor inlet by means of the unloader valve but switching the motor back to low speed. This is effected by firstly opening the contactor 14. After a period of time of 0.25 seconds set by the first timer, power is applied to the low speed motor contacts by closing the contactor 12 and opening the contactor 18. At the same time the bypass contactor 8 is opened. After a further period of 0.25 seconds set by the first timer the bypass contactor 8 is reclosed and shortly thereafter the compressor again reaches the normal low speed.

As mentioned above, the unloader valve is normally disabled during high speed operation since it is more economical to match supply of compressed air to demand by reducing the speed of the motor. However, if demand for compressed air were steady at, say, 90% of the supply rate at high speed the motor would tend to cycle rapidly between high and low speed. This is undesirable not only because it is wasteful of power and introduces inefficiency into the operation of the compressor but also because it can result in overheating of the motor. This potential problem is obviated in two separate ways.

Firstly, the controller includes a counter arranged to count the number of times the motor is switched between high and low speeds in a given period of time. If the number of switching operations in that time exceeds a predetermined number, say 30 in one hour, the controller is arranged to send an enabling signal to the unloader valve which then modulates the compressor inlet in the conventional manner. Secondly, the motor includes a temperature sensor connected to the controller and if the motor temperature should exceed a predetermined maximum desirable temperature the controller is again arranged to send an enabling signal to the unloader valve. As soon as the undesirable condition in question has disappeared the controller sends a disabling signal to the unloader valve which then ceases operation.

The unloader valve is, however, arranged to operate normally during low speed operation of the compressor. If the delivery pressure should rise, thereby indicating that the supply of compressed air exceeds demand, this increased pressure acts on the servo device which causes the unloader valve to progressively close the inlet and thus to bring supply and demand into line. If demand falls to a very low value or zero the unloader valve will close completely. If the unloader valve remains closed for a predetermined period of time of e.g. 2 minutes preset in a third timer integrated into the controller, the controller closes the minimum pressure valve and opens the vent valve and vents the interior of the compressor down to a predetermined low pressure of, say, 2 bar, as opposed to the usual discharge pressure of, say, 7 bar. The motor continues to operate but since the pressure differential across each vane is substantially reduced the power consumed by the motor is substantially reduced also. If the demand for compressed air should resume, as indicated by a reduction in the pressure sensed by the pressure transducer, normal operation is resumed. However, if the demand for compressed air should not resume within a predetermined period of time of e.g. 2 minutes the motor is switched off. The pressure within the compressor is 2 bar at this time and this will decay only very slowly. When the demand for compressed air finally resumes the compressor will restart with an internal pressure between 0 and 2 bar, depending on the length of the delay.

The motor thus consumes the minimum of power under all operating conditions and the potentially disruptive or dangerous current surge when switching the motor on or between high and low speeds is substantially reduced by switching the impedances into the supply circuit for a brief period of time. The table below sets forth typical values for the surge current magnitude and duration and the voltage drop with and without the impedances with a 75 KW PAM motor in which the steady state operating current at low and high speed is 111 amps and 148.5 amps respectively, with the impedances switched into the supply circuit for 0.25 second.

TABLE

| Switching mode | Impedances in supply circuit | Maximum surge current (Amps (RMS)) | Steady surge current (Amps (RMS)) | Surge duration (Secs.) | Voltage drop | % Voltage drop |
|---|---|---|---|---|---|---|
| 0 to low speed (0 internal pressure) | no | 1195 | 840 | 0.27 | 8.5 | 3.66 |
| 0 to low speed (0 internal pressure) | yes | 792 | 619 | 0.376 | 6 | 2.6 |
| 0 to low speed (2.0 bar internal pressure) | yes | 778 | 569 | 0.412 | 5 | 2.15 |
| Low to High speed | no | 1174 | 912 | 0.434 | 13 | 5.6 |
| Low to High speed | yes | 813 | 714 | 0.724 | 7.2 | 3.2 |
| High to low speed | no | 1096 | | 0.12 | 6 | 2.57 |
| High to low speed | yes | 551.5 | 396 | 0.18 | 4.6 | 1.97 |

As may be seen, the use of the impedances in the supply circuit results in the current surge being reduced by 30% to 50% but in its duration being increased by a similar amount, though this is of no consequence. The voltage drop as a result of this current surge is reduced by more than 50%.

What is claimed is:

1. An air compressor of sliding vane eccentric rotor type including a stator, which includes an inlet and an outlet and defines a substantially cylindrical bore, and a rotor eccentrically rotatably mounted in the bore, the rotor being connected to be rotated by a three-phase asynchronous electric motor of pole amplitude modulated type which is switchable between low speed six pole operation and high speed four pole operation under the control of a controller, a pressure sensor communicating with the outlet and connected to the controller which is arranged to produce a first signal when the compressor discharge pressure falls below a first threshold value and a second signal when the compressor discharge pressure rises above a second threshold value, each of the three electrical power supply lines of the motor being associated with a respective impedance, which is connected in parallel with a shunt path including a respective switching means, which is switchable under the control of the controller, whereby when the switching means is closed the impedance is shunted and is effectively switched out of the associated power supply line and when the switching means is open the shunt path is interrupted and the impedance is effectively switched into the power supply line, the controller being so arranged that when the compressor is operating at low speed and the first signal is produced the motor is switched to operate at high speed and when the compressor is operating at high speed and the second signal is produced the compressor is switched to operate at low speed, the controller also being so arranged that when the compressor is switched on or switched between high and low speeds the impedances are switched into the associated power lines for a predetermined period of time and are switched out of the associated power lines at all other times.

2. A compressor as claimed in claim 1 in which the compressor inlet cooperates with an unloader valve, which includes a servo device, subjected to the compressor delivery pressure, and is adapted to progressively throttle the inlet as the delivery pressure rises above a predetermined value and is connected to the controller, the controller being arranged to enable and disable the unloader valve.

3. A compressor as claimed in claim 2 in which the controller is arranged normally to disable the unloader valve when the motor is operating at high speed.

4. A compressor as claimed in claim 2 in which the controller is arranged to close the unloader valve for a predetermined period of time when the motor is switched from low speed to high speed.

5. A compressor as claimed in claim 2 in which the controller includes a counter arranged to count the number of switching operations, in which the motor is switched on or switched between high and low speeds, in a predetermined preceding period of time and is arranged to enable the unloader valve to cause it to operate normally, when the motor is operating at high speed, when the number of switching operations in the predetermined period of time exceeds a predetermined number.

6. A compressor as claimed in claim 2 in which the motor includes a temperature sensor connected to the controller and the controller is arranged to enable the unloader valve to cause it to operate normally, when the motor is operating at high speed, when the temperature of the motor sensed by the temperature sensor exceeds a predetermined value.

7. A compressor as claimed in claim 2 in which the compressor outlet includes a minimum pressure valve arranged to close the outlet at a predetermined pressure and a vent valve communicating with the outlet at a position upstream of the minimum pressure valve and arranged selectively to open under the control of the controller to vent the interior of the compressor, the controller being arranged to enable the unloader valve to cause it to operate normally when the motor is operating at low speed and to sense if the unloader valve is closed and the compressor discharge pressure is above the second threshold value and then to close the minimum pressure valve and open the vent valve whilst holding the unloader valve closed, thereby venting the interior of the compressor down to a predetermined pressure.

8. A compressor as claimed in claim 1 in which the controller is arranged to apply no electric power to the motor for a predetermined period of time when the motor is switched from high speed to low speed.

9. A compressor as claimed in claim 1 in which the value of each impedance is 0.05 to 0.5 ohms.

* * * * *